US005095547A

United States Patent [19]

Kerns

[11] Patent Number: 5,095,547

[45] Date of Patent: Mar. 17, 1992

[54] SELF DEFENSE GLOVE CONSTRUCTION

[76] Inventor: Carol S. Kerns, 1073 5th St. SW., New Philadelphia, Ohio 44663

[21] Appl. No.: 714,640

[22] Filed: Jun. 13, 1991

[51] Int. Cl.[5] ..... A41D 19/00

[52] U.S. Cl. ..... 2/160; 2/163

[58] Field of Search ..... 2/159, 160, 161 R, 163, 2/21, 16; 294/25

[56] References Cited

U.S. PATENT DOCUMENTS

| | | | |
|---|---|---|---|
| 183,375 | 10/1876 | Cutliff | 2/161 R |
| 1,161,719 | 11/1915 | Norton | 2/161 R X |
| 1,243,622 | 10/1917 | Nielsen | 2/161 R |
| 2,524,979 | 10/1950 | Kimbrell | 2/161 R |
| 3,236,553 | 2/1966 | Shrier | 2/161 R |
| 3,872,514 | 3/1975 | Liebelt | 2/159 |
| 3,911,501 | 10/1975 | Seltzer | 2/163 X |
| 4,387,838 | 6/1983 | Jackson | 2/160 X |
| 4,766,914 | 8/1988 | Briggs | 2/159 X |
| 4,884,374 | 12/1989 | Natale et al. | 2/161 R X |

*Primary Examiner*—Werner H. Schroeder
*Assistant Examiner*—Sara M. Current
*Attorney, Agent, or Firm*—Leon Gilden

[57] ABSTRACT

A glove includes a plurality of flexible metallic strips mounted in fixed communication to an exterior surface of each interior surface of every finger socket of the glove for use as a self-defense weapon. A modification of the invention includes flexible covering webs selectively mounted to overlie the abrasive webs for transport and storage of the device in a non-combative configuration of the glove construction.

1 Claim, 4 Drawing Sheets

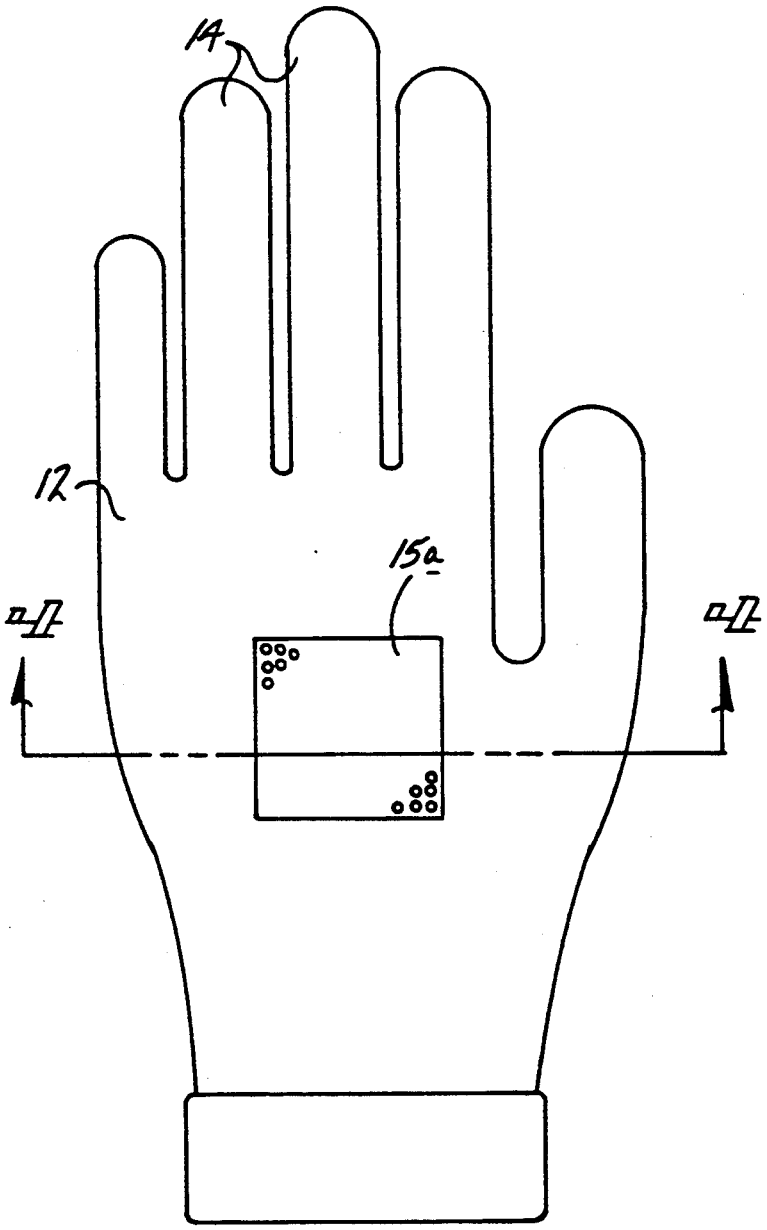
FIG 3
FIG 2
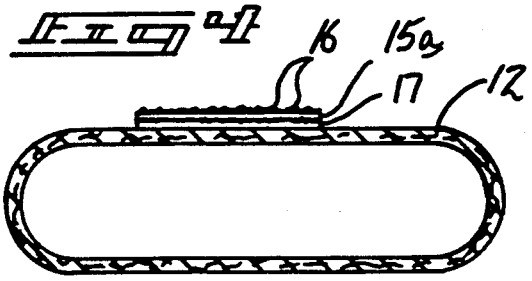

SELF DEFENSE GLOVE CONSTRUCTION

BACKGROUND OF THE INVENTION

1. Field of the Invention

The field of invention relates to glove apparatus, and more particularly pertains to a new and improved self defense glove construction wherein the same is arranged for use in a combat situation as a weapon.

2. Description of the Prior Art

Gloves of various types have been utilized throughout the prior art to provide various textures to exterior surfaces thereof. Such gloves are exemplified in U.S. Pat. No. 4,051,572 to Greenwood wherein a scouring mitten includes a series of parallel coil-like members mounted coextensively of the glove's exterior surface U.S. Pat. No. 4,587,673 to Boliard sets forth gloves for use in volley ball practice, wherein the gloves include cooperative hook and loop fastener strips to permit securement of the gloves together during particular volley ball movements.

U.S. Pat. No. 4,766,914 to Briggs sets forth a glove for use by hair dressers wherein each finger socket includes a periphery of flexible resilient comb-like teeth mounted thereabout.

U.S. Pat. No. 4,774,727 to Jackson sets forth a glove for use in fruit picking formed of a soft foam-like covering on particular portions of the finger sockets.

As such, it may be appreciated that there continues to be a need for a new and improved self defense glove construction as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of glove constructions now present in the prior art, the present invention provides a self defense glove construction wherein the same utilizes exposable abrasive plates mounted for use in a self defense mode by the impact of the abrasive plates formed each of a matrix of rigid teeth against an individual assailant. As such, the general purpose of the present invention, which will be described subsequently in greater detail, is to provide a new and improved self defense glove construction which has all the advantages of the prior art glove constructions and none of the disadvantages.

To attain this, the present invention provides a glove including a plurality of flexible metallic strips mounted in fixed communication to an exterior surface of each interior surface of every finger socket of the glove for use as a self-defense weapon. A modification of the invention includes flexible covering webs selectively mounted to overlie the abrasive webs for transport and storage of the device in a non-combative configuration of the glove construction.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved self defense glove construction which has all the advantages of the prior art glove constructions and none of the disadvantages.

It is another object of the present invention to provide a new and improved self defense glove construction which may be easily and efficiently manufactured and marketed.

It is a further object of the present invention to provide a new and improved self defense glove construction which is of a durable and reliable construction.

An even further object of the present invention is to provide a new and improved self defense glove construction which is susceptible of a low cost of manufacture with regard to both materials and labor, and which accordingly is then susceptible of low prices of sale to the consuming public, thereby making such self defense glove constructions economically available to the buying public.

Still yet another object of the present invention is to provide a new and improved self defense glove construction which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic top view of the invention.

FIG. 4 is an orthographic view, taken along the lines 4—4 of FIG. 3 in the direction indicated by the arrows.

DESCRIPTION OF THE PREFERRED EMBODIMENT

Figure 1:
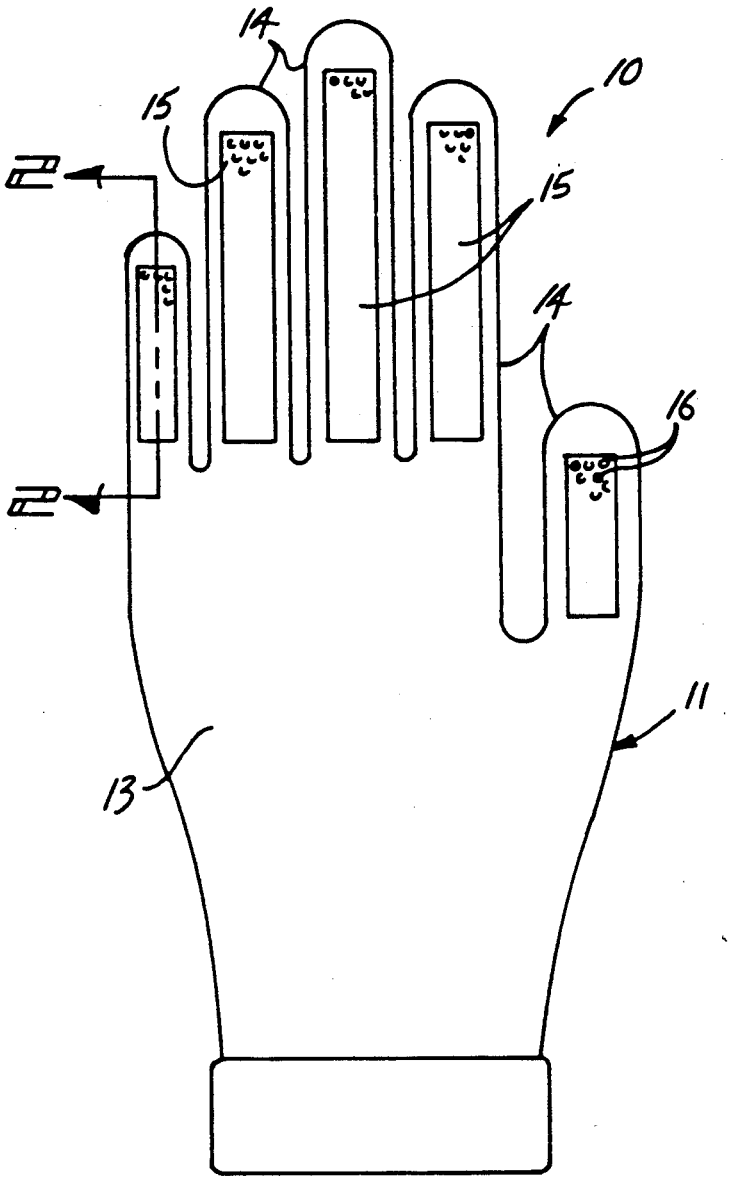
FIG. 1 is a bottom orthographic view of the instant invention.
Figure 2:
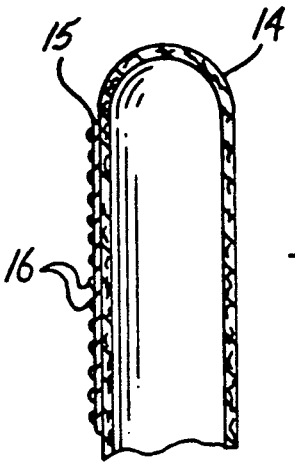
FIG. 2 is an orthographic view, taken along the lines 2—2 of FIG. 1 in the direction indicated by the arrows.

With reference now to the drawings, and in particular to FIGS. 1 to 8 thereof, a new and improved self defense glove construction embodying the principles and concepts of the present invention and generally designated by the reference numeral 10 will be described.

More specifically, the self defense glove construction 10 of the instant invention essentially comprises a glove body 11 defined by a glove body top surface 12 spaced from a glove body bottom surface 13. The glove body includes the conventional five finger sockets 14, with each of the finger sockets including a finger socket top surface and a finger socket bottom surface aligned respectively with the glove body's top and bottom surfaces 12 and 13 respectively. Each of the finger sockets 14 includes a flexible metallic abrasive sheet member 15 that includes a matrix of rigid pointed projections mounted coextensively about a top surface of each of the sheet members 15 projecting orthogonally relative to the sheet member top surface. A further such sheet member 15*a* is mounted to a top surface of the glove body 12 and is selectively securable thereto utilizing a cooperating hook and loop fastener interface 17 to selectively remove the further sheet member 15 therefrom, with the attendant pointed projection 16 fixedly formed thereon.

Figure 5:
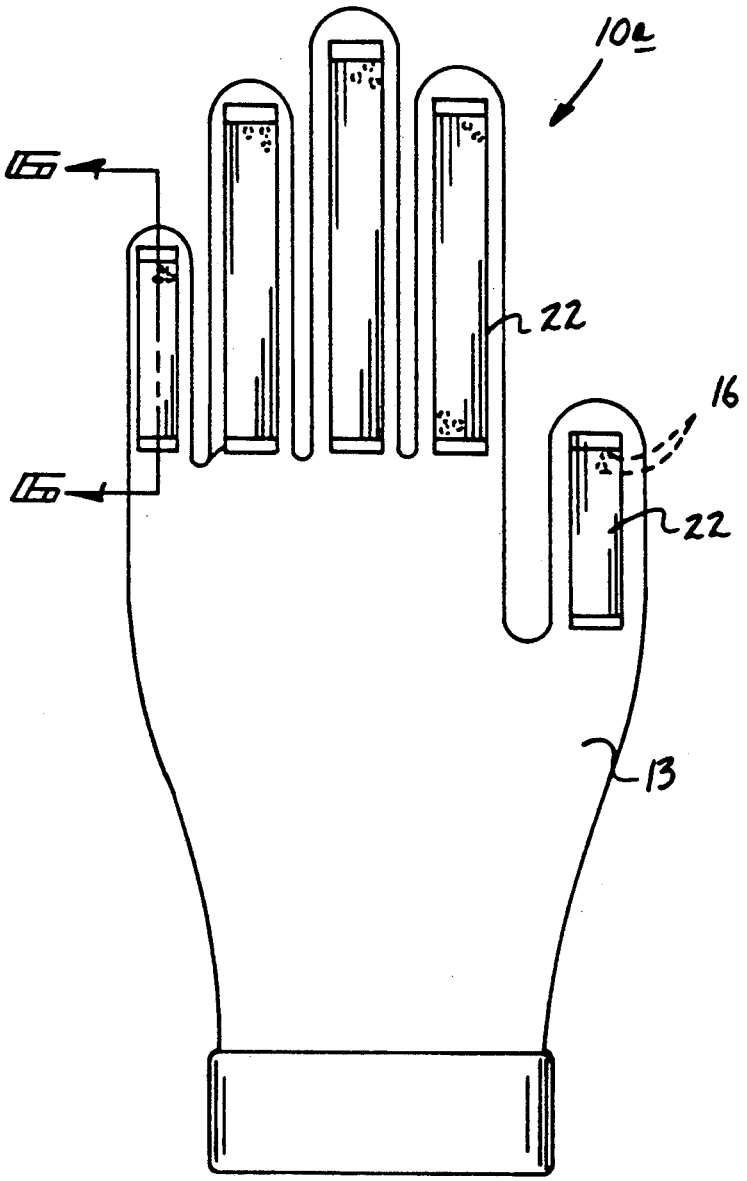
FIG. 5 is an orthographic top view of a modification of the invention.
Figure 6:
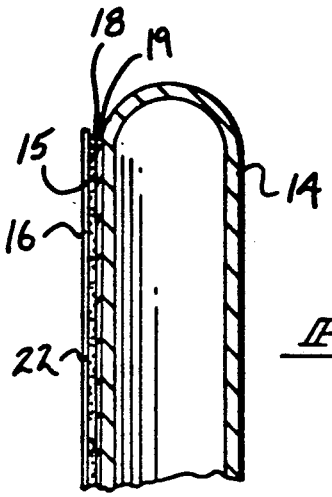
FIG. 6 is an orthographic view, taken along the lines 6—6 of FIG. 5 in the direction indicated by the arrows.

FIG. 5 and FIG. 6 illustrate the use of a modified glove construction 10 that includes a flexible covering web 22 selectively removable overlying each of the sheet members 15 and the further sheet member 15*a*. The sheet member is defined by a predetermined length, wherein each associated covering web 22 is defined by a further length greater than the predetermined length to permit mounting of a first hook and loop fastener surface 18 to each end portion of each covering web cooperative with a second hook and loop fastener 19 mounted adjacent each opposed end of each sheet member. In this manner, the abrasive sheet members 15 are covered preventing inadvertent damage and are thereby usable during periods of transport and storage.

Figure 7:
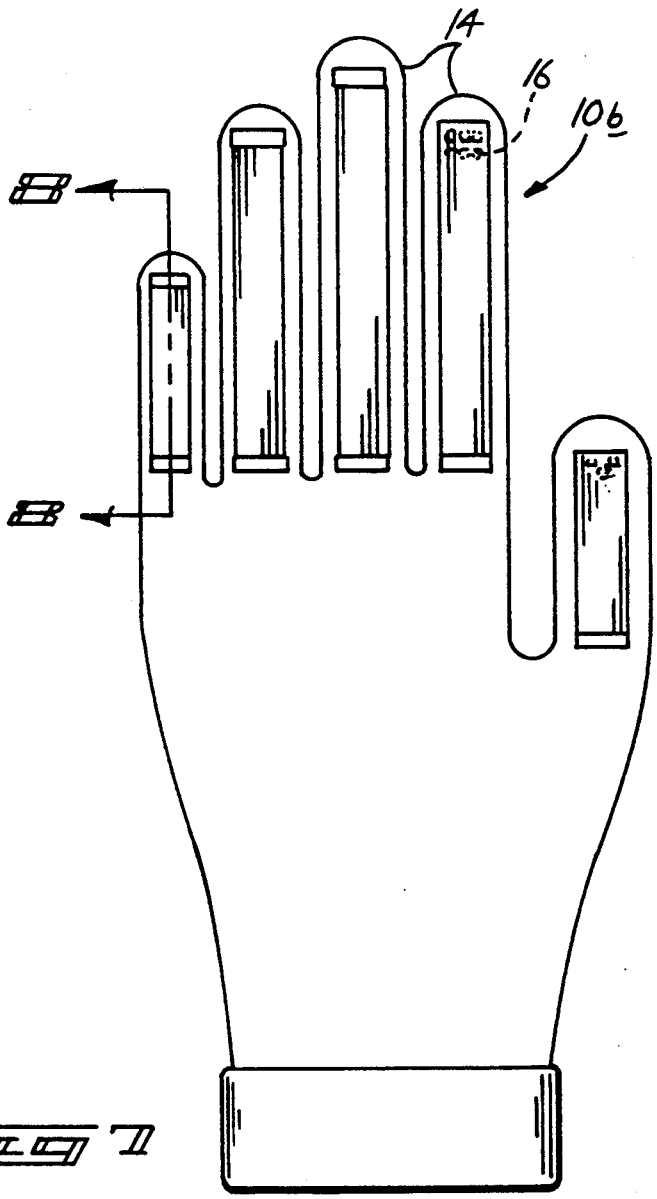
FIG. 7 is a further modified aspect of the instant invention.
Figure 8:
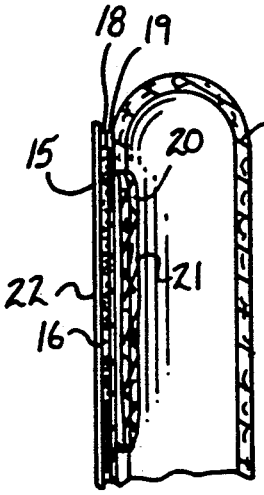
FIG. 8 is an orthographic view, taken along the lines 8—8 of FIG. 7 in the direction indicated by the arrows.

The glove construction set forth in FIGS. 7 and 8 and depicted as the member 10*b* additionally utilizes a rupturable membrane 20 mounted within an interior surface of each finger socket 14 adjacent each associated abrasive sheet member 15. Each rupturable membrane 20 encapsulates a lubricating fluid 21 therewithin, whereupon impact of the abrasive sheet members 15 upon an assailant, the fluid is dispensed within the respective finger socket providing lubrication and cushioning to an individual utilizing the glove construction as depicted by numeral 10*b*.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A self defense glove construction, comprising:

a glove body, the glove body including a glove body top surface spaced coextensively above a glove body bottom surface, the glove body including a plurality of finger sockets mounted to the glove body in communication with the glove body, and each of the finger sockets includes a socket top surface and a socket bottom surface, wherein the socket top and bottom surfaces are aligned with the respective glove body top and bottom surface, and a plurality of finger socket bottom surfaces include a flexible metallic abrasive sheet member mounted to each finger socket bottom surface, wherein each flexible metallic abrasive sheet member includes a matrix of rigid pointed projections mounted fixedly and extending orthogonally relative to a top surface of the sheet members, and wherein each abrasive sheet member includes a flexible covering web removably mounted extending over each sheet member, and wherein each flexible covering web includes opposed distal ends and a first hook and loop fastener mounted adjacent the opposed distal ends of each flexible covering web, and each finger socket bottom surface includes a second hook and loop fastener mounted adjacent each end of each abrasive sheet member permitting securement of each flexible covering web coextensively overlying each abrasive sheet member permitting selective removal of each flexible covering web, and wherein each finger socket includes a rupturable flexible membrane extending within each finger socket below a respective abrasive sheet member, and each rupturable membrane includes a lubricating fluid contained therewithin, whereupon impact of said abrasive sheet member, the rupturable membrane is ruptured effecting distribution of the lubricating fluid.

* * * * *